US011616323B1

(12) United States Patent
Ge et al.

(10) Patent No.: US 11,616,323 B1
(45) Date of Patent: Mar. 28, 2023

(54) CABLE ADAPTOR

(71) Applicant: Weidmüller Interface GmbH & Co. KG, Detmold (DE)

(72) Inventors: Xuefeng Ge, Henrico, VA (US); Matthias Bönsch, Bielefeld (DE)

(73) Assignee: WEIDMÜLLER INTERFACE GMBH & CO. KG

( * ) Notice: Subject to any disclaimer, the term of this patent is extended or adjusted under 35 U.S.C. 154(b) by 0 days.

(21) Appl. No.: 17/447,616

(22) Filed: Sep. 14, 2021

(51) Int. Cl.
*H01R 27/02* (2006.01)
*H01R 13/622* (2006.01)
*H01R 13/52* (2006.01)

(52) U.S. Cl.
CPC ..... *H01R 13/622* (2013.01); *H01R 27/02* (2013.01); *H01R 13/5221* (2013.01)

(58) Field of Classification Search
CPC .. H01R 13/622; H01R 27/02; H01R 13/5221; H01R 13/585; H01R 13/59; H01R 13/5825
See application file for complete search history.

(56) References Cited

U.S. PATENT DOCUMENTS 3,291,895 A * 12/1966 Van Dyke ..... H01R 9/0503 174/75 C
3,706,958 A * 12/1972 Blanchenot ..... H01R 9/0521 439/584

* cited by examiner

*Primary Examiner* — Tho D Ta
(74) *Attorney, Agent, or Firm* — Laubscher & Laubscher PC

(57) ABSTRACT

An adaptor is provided for connecting an electrical cable with an electrical connector. The adaptor includes a housing and an insert which are coaxially arranged and connected for free rotation relative to each other. The outer surface of the insert contains an annular recess and at least one pin is arranged on an inner surface of the housing. When a portion of the insert including the recess is arranged within a portion of the housing, the pin is inserted into the recess to connect the insert with the housing while permitting rotation therebetween. The free rotation prevent torque from being transmitted to an electrical cable connected with the insert.

6 Claims, 2 Drawing Sheets

CABLE ADAPTOR

BACKGROUND OF THE INVENTION

It is known in the art to provide an adaptor for connecting an electrical connector with an electrical cable. Such adaptors typically include a screw fitting for connecting a cable with the connector and an end cap which relieves strain in the cable and seals and protects the cable from outside contaminants. However, the screw fitting and end cap combination do not prevent torque from being transmitting between the connector and the cable when either component is subjected to twisting or rotation. The torque ultimately weakens the connection or causes damage connector or cable, limiting the useful life of the adaptor.

The present invention was developed in order to overcome these and other drawbacks of conventional cable adaptors by providing an adaptor which is free of torque and while still relieving strain and providing protection from outside contaminants.

SUMMARY OF THE INVENTION

Accordingly, it is primary object of the invention to provide an adaptor for connecting a cable with an electrical connector including a housing containing a longitudinal through channel. A first portion of the housing has a cylindrical configuration and contains a chamber communicating with the through channel. An insert is connected with the housing for free rotation relative of the housing. When the housing is connected with an electrical cable and the insert is connected with an electrical connector, the cable and housing are free to rotate relative to each other without any torque being applied to either.

According to a preferred embodiment, the insert contains a longitudinal through channel coaxial with the housing through channel. A first portion of the insert is arranged in the housing chamber. The first portion of the housing insert contains an annular recess, and the housing first portion includes at least one pin which extends into the insert recess in order to retain the insert within the housing first portion chamber while permitting free rotation of the insert relative to the housing. If desired, a pair of pins extend from opposite sides of the housing first portion into the insert recess to stabilize the adaptor.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
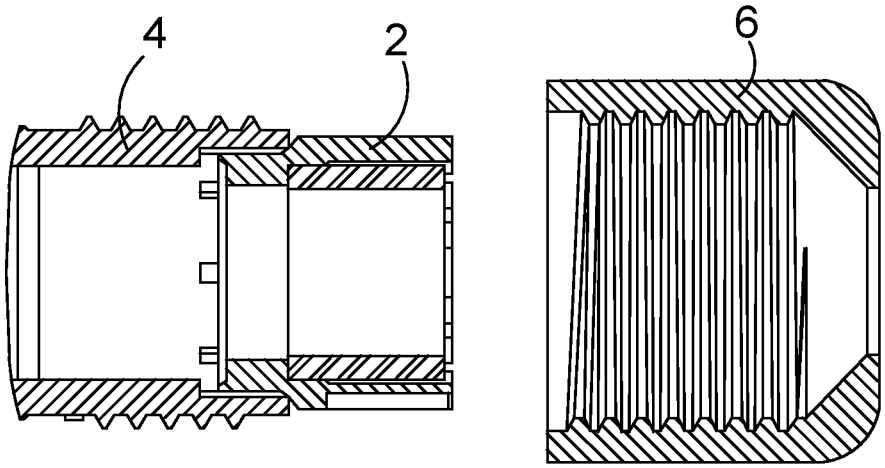
(PRIOR ART) FIG. 1
FIG. 1 is an exploded front view of a cable adaptor and end cap according to the prior art.

Referring first to FIG. 1, an adaptor 2 according to the prior art has a generally cylindrical configuration for receiving a cable (not shown). The adaptor is arranged in a threaded end portion 4 of an electrical connector. A screw cap 6 contains internal threads which are connected with the threaded portion of the connector. As the end cap is screwed onto the connector threaded portion, the adaptor is radially compressed to grip the cable. The end cap provides strain relief to the cable and also cooperates with the adaptor to seal and protect the cable from contaminants.

Figure 2:
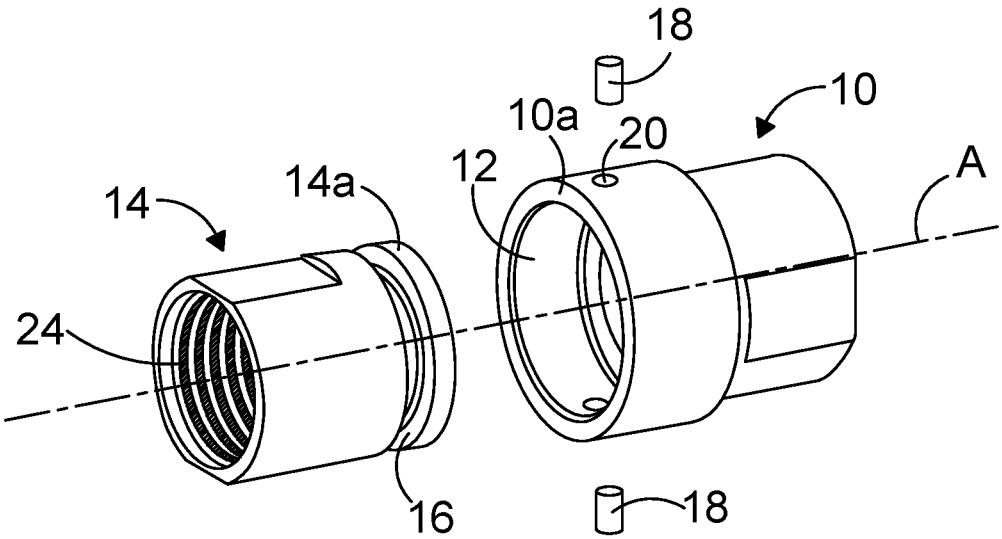
FIG. 2 is an exploded perspective view of the cable adaptor according to the invention.
Figure 3:
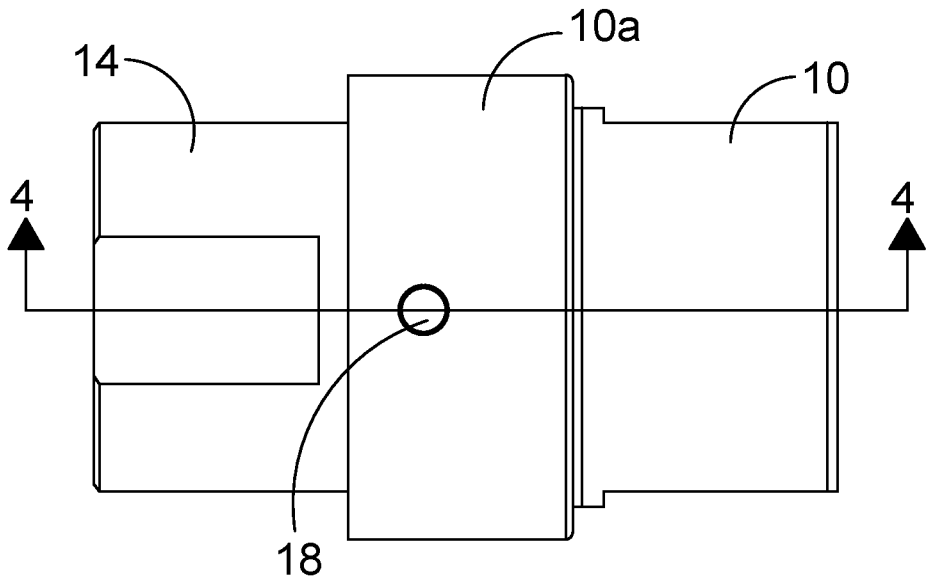
FIG. 3 as a top view of the cable adaptor of FIG. 2 in an assembled condition.
Figure 4:
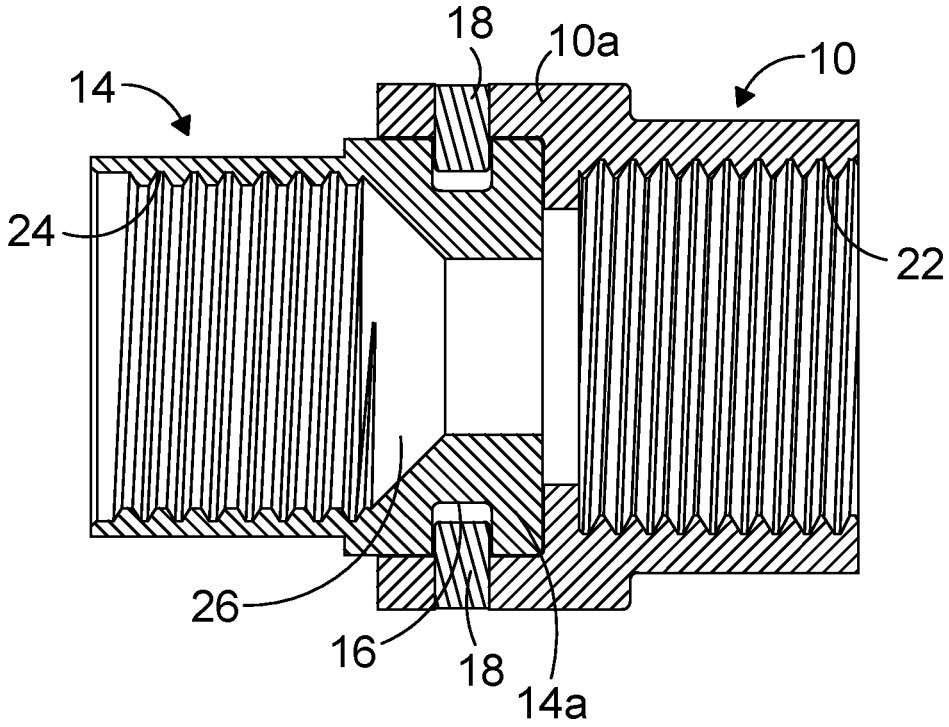
FIG. 4 is a sectional view of the cable adaptor taken along line 4-4 of FIG. 3.

The cable adaptor according to the invention is shown in FIGS. 2-4. It includes a housing 10 which contains a through channel extending along a longitudinal axis A. The housing includes a first portion 10*a* having a cylindrical configuration which contains a chamber 12 communicating with the housing through channel. An insert 14 is connected with the housing 10 for free rotation relative to the housing. More particularly, the insert includes a first portion 14*a* having a cylindrical configuration and which is arranged in the housing chamber. The outer diameter of the insert first portion is slightly less than the inner diameter of the housing first portion to allow the insert to rotate about the axis A relative to the housing. The insert contains a longitudinal through channel which is coaxial with the housing through channel.

The outer surface of the insert first portion 14*a* contains an annular recess 16 which is arranged within the housing first portion chamber when the insert is arranged in the housing. The housing first portion 10*a* includes at least one projection 18 which extends into the insert recess 16 to retain the insert within the housing first portion chamber while permitting free rotation of the insert. Preferably, a pair of projections are provided in the housing first portion which are arranged diametrically opposed from each other so that the insert remains centered and balanced within the housing first portion chamber. It will be appreciated that any number of spaced projections may be provided on the housing first portion. If multiple projections are provided, they are preferably arranged in diametrically opposed pairs and equally spaced.

In a preferred embodiment, the housing first portion 10*a* contains a through opening 20 having an axis which extends perpendicular to the longitudinal axis A. The through opening 20 is configured to receive a pin which serves as the projection 18. That is, the pin has a diameter corresponding with the diameter of the through opening to provide a force fit connection between the pin and the opening. Accordingly, in order to assemble the adaptor, the first portion 14*a* of the insert 14 is inserted into the chamber 12 of the housing first portion 10*a* with the annular recess 16 arranged adjacent to the housing first portion through opening 20. A pin is inserted in the housing through opening 20. The pin has a length sufficient to extend into the annular recess 16 to retain the insert within the housing. Additional through openings are provided to receive additional pins if desired. In the embodiment shown in the drawing, two pins and corresponding through openings are provided.

The housing 10 includes a second portion 10*b* having an internal threaded surface 22 for receiving a threaded tube or an electrical connector (not shown). The insert 14 also includes a second portion 14*b* having an internal threaded surface 24 for receiving a threaded end portion 4 of an electrical connector such as shown in FIG. 1. The inner surface 26 of the insert first portion is tapered to provide strain relief and sealing of a cable (not shown) arranged therein.

The housing and insert are formed of a durable material such as synthetic plastic or metal. Due to the free independent rotation between the housing and insert, no torque is transmitted from one side of the adaptor to the other. The housing and insert are designed to withstand torque applied to the adaptor from devices connected with the opposite ends of the adaptor, i.e. with the housing and insert threaded second portions, respectively. However, with the free rotation of these components, the torque is not transmitted through the adaptor which preserves the life of a cable arranged therein.

While the preferred forms and embodiments of the invention have been illustrated and described, it will be apparent to those of ordinary skill in the art that various changes and modifications may be made without deviating from the inventive concepts set forth above.

What is claimed is:

1. An adaptor for connecting a cable with an electrical connector, comprising (a) a housing containing a longitudinal through channel, a first portion of said housing having a cylindrical configuration and containing a chamber communicating with said through channel; and (b) an insert connected with said housing first portion for rotation relative to said housing and containing a longitudinal through channel coaxial with said housing through channel, a first portion of said insert being arranged in said housing chamber and having a tapered inner wall surface with an internal diameter which increases from a first end of said insert within said housing chamber toward an intermediate portion of said insert, said tapered inner wall surface providing strain relief and protection to a cable arranged within said insert.

2. An adaptor for connecting a cable with an electrical connector, comprising (a) a housing containing a longitudinal through channel, a first portion of said housing having a cylindrical configuration and containing a chamber communicating with said through channel; and (b) an insert rotatably connected with said housing first portion and containing a longitudinal through channel coaxial with said housing through channel, a first portion of said insert being arranged in said housing chamber and having a tapered inner wall surface with an internal diameter which increases from a first end of said insert within said housing chamber toward an intermediate portion of said insert, said tapered inner wall surface providing strain relief and protection to a cable arranged within said insert, an outer surface of said insert first portion containing an annular recess and said housing first portion including at least one projection which extends into said insert recess to retain said insert within said housing first portion chamber while permitting free rotation of said insert relative to said housing.

3. An adaptor as defined in claim 2, wherein said housing first portion includes a pair of projections extending from opposite sides thereof.

4. An adaptor as defined in claim 3, wherein said housing first portion contains a pair of radially extending openings communicating with said chamber and said projections comprise pins extending through said openings into said insert recess.

5. An adaptor as defined in claim 2, wherein said housing includes a second portion having an internal threaded surface for receiving one of a threaded tube and connector.

6. An adaptor as defined in claim 2, wherein said insert includes a second portion having an internal threaded surface for connection with a cable fitting.

* * * * *